US005269247A

United States Patent [19]

Jean

[11] Patent Number: 5,269,247

[45] Date of Patent: Dec. 14, 1993

[54] SEALED THERMALLY INSULATING VESSEL FORMING PART OF THE SUPPORTING STRUCTURE OF A SHIP

[75] Inventor: Pierre Jean, Dampierre, France

[73] Assignee: Gaz Transport, Paris, France

[21] Appl. No.: 972,373

[22] Filed: Nov. 5, 1992

[30] Foreign Application Priority Data

Nov. 20, 1991 [FR] France ..... 91 14320

[51] Int. Cl.[5] ..... B63B 25/08

[52] U.S. Cl. ..... 114/74 A

[58] Field of Search ..... 114/74 R, 74 A; 220/90 L

[56] References Cited

U.S. PATENT DOCUMENTS 3,896,961 7/1975 Guilhem et al. ..... 114/74 A

FOREIGN PATENT DOCUMENTS 2413260 7/1979 France .

2549575 1/1985 France .

89/09909 10/1989 PCT Int'l Appl. ..... 114/74 A

*Primary Examiner*—Jesus D. Sotelo

*Attorney, Agent, or Firm*—Pollock, Vande Sande & Priddy

[57] ABSTRACT

A sealed insulating vessel forming part of the supporting structure of a ship is provided. This vessel has two sealing barriers alternating with two insulating barriers. The tanks 3 of the secondary insulating barrier are coupled to the supporting structure of the ship by lugs 5 fixed at right angles with thick internal bulkheads, the bulkheads longitudinally supporting the coupling elements of the primary barrier. These coupling means consist of a sliding joint with a double fold disposed between two plates 21 of the primary insulating barrier, the two plates 21 being held by brackets welded to a weld support 18 which forms part of the coupling elements.

18 Claims, 5 Drawing Sheets

SEALED THERMALLY INSULATING VESSEL FORMING PART OF THE SUPPORTING STRUCTURE OF A SHIP

DESCRIPTION TECHNICAL FIELD

This invention relates to the production of sealed thermally insulating vessels intended for the sea transport of liquefied gases and in particular for the transport of liquefied natural gases with a high methane content.

BACKGROUND ART

French Patent Specifications Nos. 1 438 330, 2 105 710 and 2 146 612 already describe the production of a sealed insulating vessel forming part of the supporting structure of a ship and consisting of two successive sealing barriers, a primary sealing barrier in contact with the liquefied gas being transported and a secondary sealing barrier disposed between the primary barrier and the supporting structure of the ship, these two sealing barriers alternating with two thermally insulating layers referred to as "insulating barriers". In these embodiments, the primary and secondary insulating barriers consist of parallelepipedal tanks filled with a particular insulant and the primary and secondary sealing barriers consist of metal strakes, e.g. made of invar, welded via their bent over edges to either side of a welding flange.

French Patent Specification No. 2 462 336 proposes an embodiment of a vessel in which the secondary insulating barrier is formed by a thick layer of cellular material fixed to the supporting structure of the ship, the primary insulating barrier consisting of a rigid plate having an advantage with respect, inter alia, to mechanical resistance, as the rigidity of the plates of the primary insulating barrier allows for improved resistance with respect to the shocks produced at the walls of the vessel by the movements of the liquid being transported, these movements being the result of the roll and pitch of the ship. In this embodiment, the primary barrier is coupled to the secondary barrier without any connection to the supporting structure of the ship, this being very advantageous with respect to the insulating properties. However, the essential disadvantage is that automated construction is virtually impossible, so that the manufacturing price proves prohibitive, in spite of the good results obtained. Moreover, at the primary insulating barrier, a sealed bulkhead is created between two adjacent elements of the said barrier, making it very difficult to purify the primary barrier by the circulation of inert gas or to monitor the seal by the injection of tracer gas.

French Patent Specification No. 2 504 882 proposes an embodiment of a vessel of this kind in which the secondary insulating barrier consists, of parallelepipedal tanks filled with insulant and the primary insulating barrier consists of plates formed by a cellular layer fitted to a rigid panel. This type of structure has the advantage that it retains the essential advantage of the rigidity of the primary insulating barrier as proposed in the aforesaid Patent Specification No. 2 462 336. Unfortunately, this device also has a serious disadvantage, as the primary barrier is coupled directly to the supporting structure of the ship by means of anchoring members which traverse the secondary sealing barrier. It has been found that under certain conditions this technique is capable of producing zones of concentrated stress, this being disadvantageous with respect to safety. In addition, the anchoring members establish a direct thermal bridge between the primary barrier and the supporting structure of the ship, this being very disadvantageous with respect to the insulating capacity.

French Patent Specification No. 2 629 897 proposes an embodiment of a vessel of this kind in which, on the one hand, rigid plates providing good mechanical resistance to shocks from the liquid being transported are used as an element of the primary insulating barrier and, on the other hand, no direct thermal bridge is created between the primary barrier and the supporting structure of the ship, and, finally, mounting can be achieved by automatic mounting means, reducing the manufacturing cost of the vessel. This embodiment uses a secondary insulating barrier consisting in the known manner of rigid tanks filled with a particular insulating material. The secondary sealing barrier consists of invar strakes welded via their bent over edges to either side of a weld support held on the tanks of the secondary insulating barrier and this same weld support serves to hold the elements of the primary insulating barrier. However, this embodiment has a disadvantage as a result of the fact that the elements of the secondary insulating barrier are fixed via their corners and that the tensile forces exerted on the weld supports are applied in zones remote from the fixing corners, which may result in dynamic deformation of the elements of the secondary insulating barrier being used. Moreover, the primary barrier is coupled exclusively by means of a weld support held by a right-angled fold to the face of the tanks of the secondary insulating barrier which supports the secondary sealing barrier. This method of operation does not give the degree of tear resistance desired for maximum safety and, in addition, it makes it necessary to ensure a screw connection between the face which supports the coupling and the reinforced internal bulkhead situated at right angles with the said coupling, resulting in a not inconsiderable increase in the cost price. Finally, as in the aforesaid prior embodiments, one single retaining member cooperates with four adjacent elements, making it difficult to mount.

SUMMARY OF INVENTION

This invention therefore relates to the new industrial product consisting of a sealed thermally insulating vessel forming part of the supporting structure of a ship, the said vessel having two successive sealing barriers, a primary sealing barrier in contact with the product contained in the vessel and the other secondary sealing barrier disposed between the primary barrier and the supporting structure of the ship, these two sealing barriers alternating with two thermally insulating barriers, the primary insulating barrier bearing elastically against the secondary sealing barrier by virtue of coupling means disposed in a substantially continuous linear manner and mechanically connected to the secondary insulating barrier, the primary insulating barrier consisting of substantially parallelepipedal rigid plates between which the said coupling means pass, the secondary insulating barrier consisting of an assembly of substantially parallelepipedal insulating tanks provided with internal bulkheads fixed to the supporting structure of the ship by means of retaining members integral with the said supporting structure which cooperate with fixing devices disposed along the edge of the tanks of the secondary insulating barrier, the said tanks being separated from one another by substantially rectilinear joint zones in which the aforesaid retaining members are disposed, each tank having, at right angles with each groove adapted to receive a coupling means, a thick internal bulkhead fixed to the faces defining the tank, characterised in that, outside the vessel corners, the retaining members used to hold the secondary insulating barrier on the supporting structure of the ship are aligned at right angles with the grooves in which the coupling means are inserted.

In the known manner, each retaining member has, on the one hand, a stud bolt welded via its base to the supporting structure of the ship and, on the other hand, a nut which bears against a fixing device integral with a tank of the secondary insulating barrier. According to an advantageous embodiment, the said fixing device is the edge folded at a right angle of a lug fixed to the narrow side of each tank at right angles with the end cross section of each thick bulkhead of the tank, this right-angled fold being elastically deformable. It can be provided that a nut bears against the said edge folded at a right angle by means of a plate bearing simultaneously against the edges of two lugs belonging to two adjacent tanks, thereby forming a flexible connection between the tanks and the supporting structure of the ship.

According to this technique, the tanks are fixed in pairs, this being more simple than in fours, as is the case in the prior art. However, above all, the tensile forces transmitted by the coupling means are transmitted via a thick bulkhead just at right angles with the retaining members, this reducing the dynamic deformation of the tanks being used. Finally, two successive retaining members on one same line perpendicular to the coupling means are spaced at an interval of half the width of a tank, the thick bulkheads of a tank being disposed at a quarter of the width from each longitudinal edge of the tank. In the prior art, the spacing in question is the width of a tank. In the case of tanks having a constant surface, this therefore means that the retaining members are less far apart from one another, thus resulting in improved transfer to the supporting structure of the ship of the stresses applied to the vessel.

The secondary sealing barrier advantageously consists of metal strakes with edges folded over towards the interior of the vessel, the said strakes being made of sheet metal with a low coefficient of expansion and being butt welded via their bent over edges to the two faces of a weld support which is held mechanically on the elements of the secondary insulating barrier by a sliding joint. Each coupling means consists of a first and a second part, a weld support forming a first part of a coupling means and having its free end set back with respect to the plane of the primary sealing barrier, the rigid plates of the primary insulating barrier having, with respect to each weld support and over their entire length, a fixing tongue, two right-angled strips being welded to either side of the said weld support and bearing elastically via their non-welded flange against the said tongues in order to form a second part of a coupling means.

In a preferred embodiment of the sliding joint which holds the weld support on the tanks of the secondary insulating barrier, the said joint is of the known type consisting, on the one hand, of a first U-shaped fold formed on a longitudinal edge of the weld support and, on the other hand, of a second U-shaped fold formed on a fixing strip, the two folds fitting one into the other, each fixing strip being mounted and held in one of the grooves formed at right angles with each thick bulkhead of the tanks, the width of the said groove only being slightly greater than that of the two folds fitted one into the other.

A fixing strip can be held in its groove by retaining means which traverse transversely at the groove of the thick bulkhead where the said fixing strip is disposed. The abovementioned retaining means are advantageously hooks.

Each tank of the secondary insulating barrier can be made in the known manner of plywood, the tanks being filled with a particular insulating material such as perlite. Outside the vessel corners, the elements of the secondary insulating barrier are preferably all identical rectangular parallelepipeds.

It can be ensured in the known manner that the tanks of the secondary insulating barrier bear against the supporting structure of the ship by means of beads made of a curable resin, these beads restoring a defined geometrical surface by means of discontinuous elements, irrespective of the random spacings of the supporting structure in the static state with respect to its theoretical surface. A film of plastic material is advantageously interposed between the supporting structure and the said resin beads in order to prevent the latter from sticking to the said structure, this allowing for dynamic deformation of the supporting structure between the retaining members without affecting the secondary insulating barrier.

In a known manner, it is advantageous for the secondary insulating barrier to be under a low pressure of between 0.1 and 300 mbar as the insulating properties of the second insulating barrier are improved in this manner. There are of course joint zones between the tanks of the secondary insulating barrier as a result of the presence of the lugs and the retaining members. It can advantageously be provided that these joint zones are filled with insulating material. This insulating material can be in the form of a strip, the thickness of which corresponds to that of the joint zone to be filled, the said strip comprising laterally at least one longitudinal groove closed in a non-sealed manner at its ends. These grooves mean that it is possible to establish low pressure in the secondary insulating barrier. The non-sealed closure of the ends makes it possible to reduce the pressure, but prevents natural convection being established between the adjacent zone of the supporting structure and the groove, which would increase heat exchange.

In order to ensure continuous support of the primary sealing barrier it is possible to provide a cover strip at right angles with each weld support and the tongues of the plates of the primary insulating barrier with which it cooperates, the face of said cover strip directed towards the interior of the vessel being level with the faces of the plates of the primary insulating barrier which supports the primary sealing barrier. According to an advantageous embodiment leading to the advantage of good mechanical resistance of the primary insulating barrier, the rigid plates forming the said primary insulating barrier are formed by a layer of cellular material, e.g. a polyurethane foam, stretched between two rigid panels, e.g. of plywood, and possibly surrounded over its edges by means of rigid elements having the thickness of the layer of cellular material. It can advantageously be provided that the primary insulating barrier is swept by a neutral gas such as nitrogen. The excess pressure required for sweeping, when it is maintained while the vessel is empty, or that resulting from the injection of tracer gas for the detection of leaks, does not pose any problem for the coupling of the primary barrier, as the sliding joint having a double U-shaped fold used according to a preferred embodiment of the invention is capable of supporting several tonnes per linear meter when the weld support and the fixing strip are made of invar sheet having a thickness of 0.5 mm.

In a preferred embodiment, the primary sealing barrier is formed by metal strakes with edges bent over towards the interior of the vessel, the said strakes consisting of sheet metal having a low coefficient of expansion, e.g. invar, and being butt welded via their bent over edges to the two faces of a welding flange which is held mechanically by a cover strip of the primary insulating barrier. The welding flange advantageously has a right-angled profile, the small side of which is engaged in a groove formed over the entire length of the cover strip.

According to a technique previously described by the applicant company, the connecting corner of the elements of the primary and secondary barriers in the zones in which the transverse bulkheads of the ship are connected to the double hull is made in the form of a ring, the structure of which remains constant over the entire length of the curve of intersection of the said transverse partition with the double hull of the ship. In a corner formed by the double hull of the ship and a transverse bulkhead, it is proposed according to the invention to couple two perpendicular anchoring bands connected by means of angle brackets to the two secondary sealing barriers to the perpendicular supporting walls by means of a unidirectional connection, the said angle brackets being connected to one another by a connecting band perpendicular to the plane bisecting the corner in question, at least one of the anchoring bands extending substantially in its plane beyond the angle bracket connected thereto in order to join the primary sealing barrier associated with one of the supporting walls of the corner in question, the primary sealing barrier associated with the other supporting wall being connected by the sealed welding of a right-angled strip to its abovementioned homologue and possibly to the anchoring band situated in its plane. The unidirectional connection of an anchoring band may have stud bolts fixed to the supporting structure and an anchoring bracket with a right-angled profile, one flange of which is held on each bolt by the nut associated with the latter and the other flange of which is welded to the anchoring band, the said anchoring bracket being free to move towards its associated supporting wall.

SUMMARY OF DRAWING

The subject matter of the invention will be more readily understood from the following description of one embodiment given purely by way of a non-limiting example with reference to the accompanying drawings, in which.

BEST AND VARIOUS MODES FOR CARRYING OUT INVENTION

Figure 1:
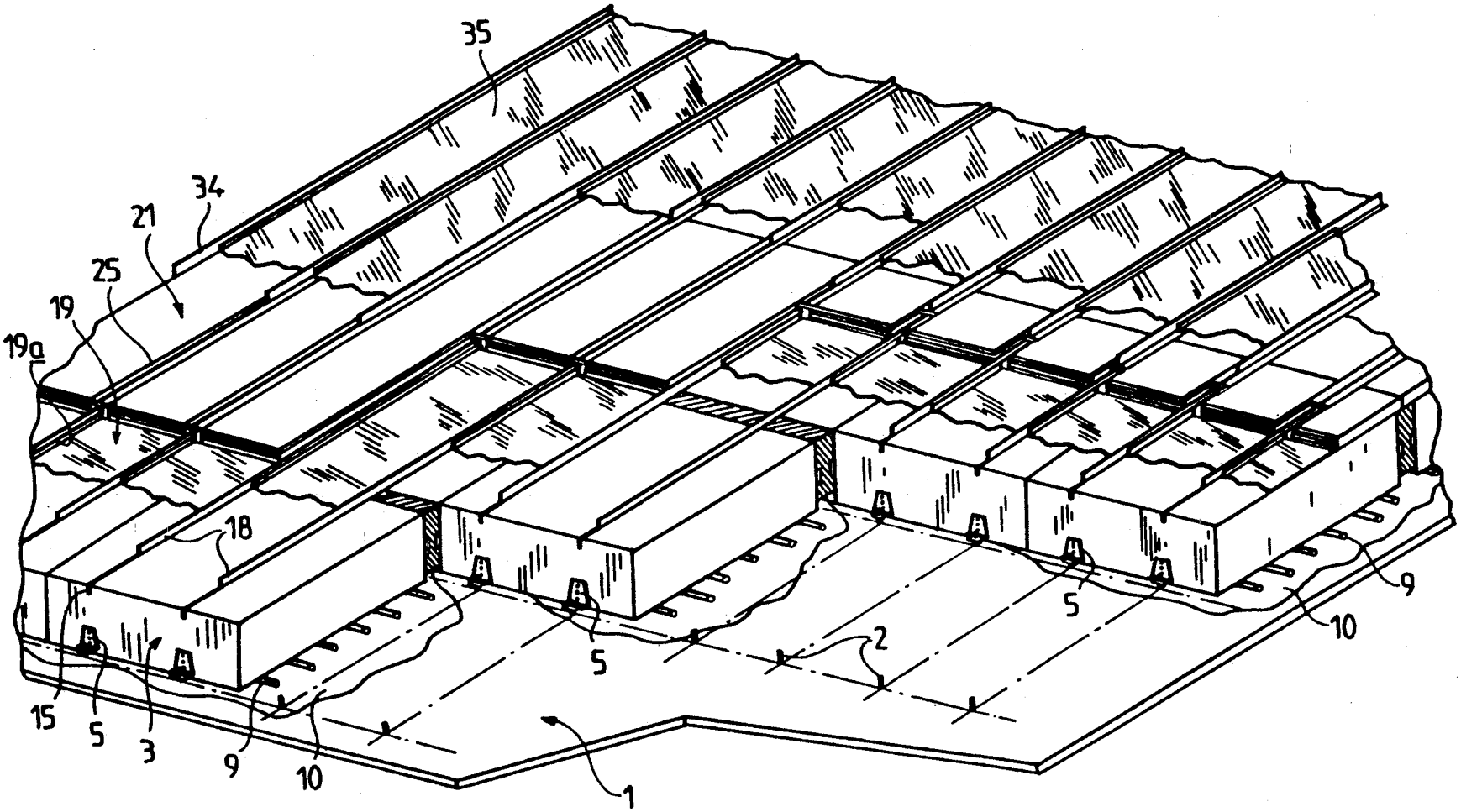
FIG. 1 is a perspective, with broken away portions, of the primary and secondary barriers of a vessel according to the invention.
Figure 2:
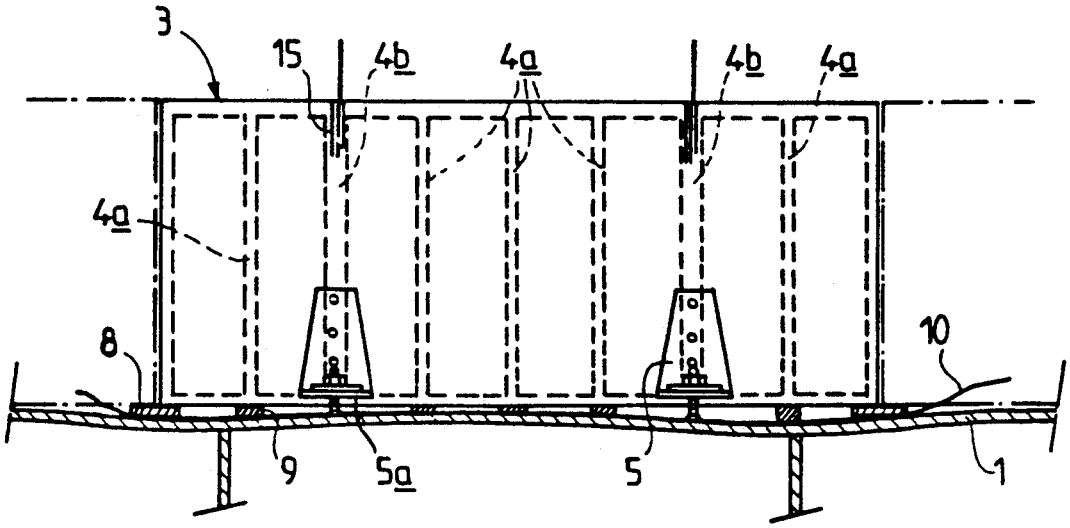
FIG. 2 is an elevation of the narrow side of a tank of the secondary insulating barrier.
Figure 3:
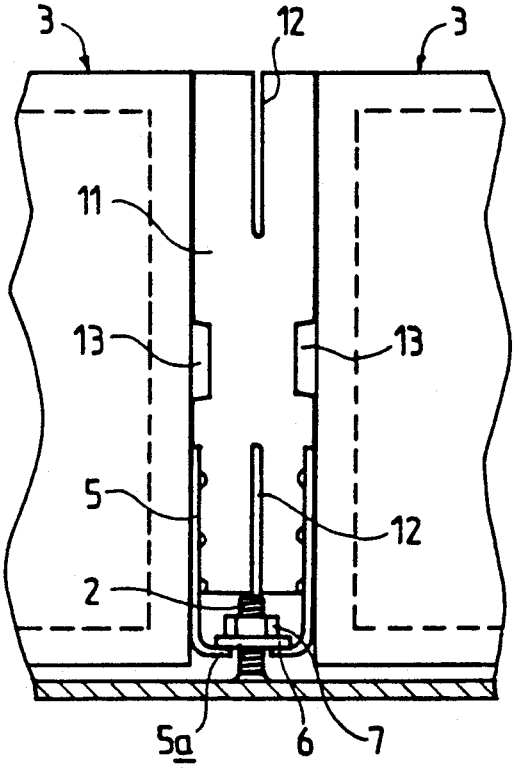
FIG. 3 shows the joint zone between two tanks of the secondary insulating barrier at right angles with the retaining members fixed to the supporting structure of the ship.
Figure 4:
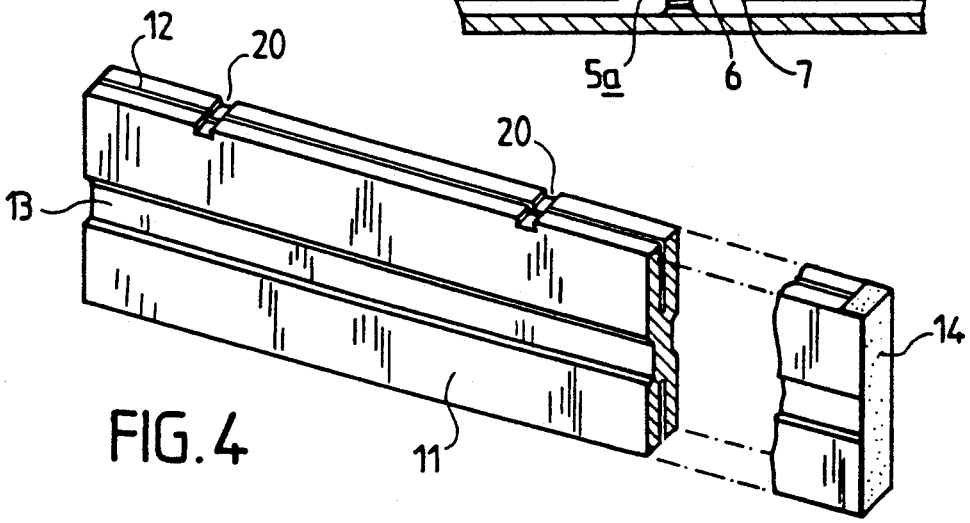
FIG. 4 is a perspective, with broken away portions, of the structure of the insulating strip mounted between two adjacent tanks of the secondary insulating barrier at right angles with the retaining members.

Referring to the drawing, it will be seen that the reference numeral 1 designates the supporting structure of a vessel according to the invention. This supporting structure can be either the internal wall of the double hull of the ship, in which case it is designated by the reference numeral 1*a*, or a transverse bulkhead of the ship, in which case it is designated by the reference numeral 1*b*. Hereinafter, when there is no need to distinguish between these two types of supporting structure, only the generic reference numeral 1 will be used.

Retaining members consisting of stud bolts 2 are welded to the wall 1. These stud bolts are aligned in two perpendicular directions, one of which is perpendicular to the axis of the ship. On this line, the bolts are spaced at 500 mm and two successive lines of bolts on a line of this kind perpendicular to the axis of the ship are spaced at 1 200 mm. The bolts 2 are used to fix tanks to the supporting structure 1. The tanks form the elements of the secondary insulating barrier of the vessel. Each tank is designated in general by the reference numeral 3. It consists of a parallelepipedal box of plywood having a width of 1 m and a length of 1.20 m. Longitudinal bulkheads are disposed inside this box, extending between the two large rectangular faces of the box. The thickness of the box is 430 mm. The internal transverse bulkheads of each tank are of two types. Some are relatively thin and are designated by the reference numeral 4*a* and the others are relatively thick and are designated by the reference numeral 4*b*. The thick bulkheads 4*b* are 250 mm from the longitudinal edges of the tank 3. The tank 3 has 7 internal bulkheads spaced at regular intervals. The interior of the tank is filled with a particular insulating material, such as that known by the name "perlite". A lug 5 is fixed to the edges of the tank 3 perpendicular to the internal bulkheads, in the median plane of the thick bulkheads 4*b*. This lug has an edge 5*a* folded at a right angle. The lugs 5 are fixed to the narrow side of each tank 3 by screwing in the median plane of each thick bulkhead 4*b*. The edges 5*a* folded at a right angle cooperate with a plate 6 held by means of a nut 7 which is screwed on to each stud bolt 2. Two tanks 3, the faces of which carrying the fixing lugs 5 are opposite one another, are fixed by the same two bolts 2. It will be seen therefore that the tanks 3 are mounted in pairs, this being simpler than in the case of the prior art in which they were mounted in fours. The edges 5*a* have an inherent elasticity as a result of the folding of the fixing lug 5, allowing for a certain independence between the deformation of the supporting bulkhead and that of the tank 3.

The tank 3 is mounted using the interposition of beads 9 made of a curable resin 9. These beads are disposed longitudinally on that large face of the tank 3 opposite the supporting structure 1 and the tank is pressed towards the supporting structure until wedges 8 of predetermined dimensions fixed to the four corners of the tank come to bear against the said supporting structure 1. In this position, the beads of curable resin 9 are more or less crushed and this technique makes it possible to correct the defects found in the supporting bulkhead 1 in the static state with respect to the theoretical surface. The dimensioning of the wedges 8 is calculated according to a precise marker of the spatial positioning of the inner face of the supporting bulkhead 1. When this positioning of a tank has been effected, the tank 3 is fixed by virtue of the bolts 2 and the curable beads 9 harden in a few hours by polymerisation, so that it is then possible to remove the wedges 8. Before the tank 3 is applied to the supporting bulkhead 1, a polyene film 10 is interposed between the latter and the beads 9 in order to prevent the resin of the bead 9 from sticking to the supporting bulkhead 1, thereby allowing for dynamic deformation of the supporting bulkhead 1 without the tank 3 being subjected to the stresses resulting from the said deformation between the retaining members 2.

At right angles with the bolts 2, the tanks 3 are spaced by a joint zone having a width of approximately 60 mm. A strip 11 made of a thermally insulating material such as polyurethane foam is interposed in this joint zone. This strip 11 is in the shape of a rectangular parallelepiped. Its height is 400 mm and its length is 1.20 m. A slot 12 approximately 3 mm wide is formed on these longitudinal edges corresponding to the thickness of the strip, in the median plane of the strip. This slot 12 gives a certain elasticity to the mounting moment and helps to hold the strip 11 in the joint zone. The height of the strip 11 is such that one of its narrow longitudinal edges is situated precisely at the face of the tanks 3 directed towards the interior of the vessel. A groove 13 is formed along the median line on each of the large lateral faces of the strip 11, said groove being stopped in a non-sealed manner at each of the ends of the strip 11 by an adhesive tape 14 which covers all of the transverse end of the strip 11.

A groove 15 is formed in the upper face of the tanks 3 at right angles with the thick internal bulkheads 4*b*, extending over the entire length of the tank. A fixing strip 16, one longitudinal edge of which is folded into a U to form a fold 16*a*, is mounted in this groove 15. The fixing strip 16 is held in the interior of the groove 15 by hooks 17 disposed transversely. A weld support 18, one edge of which is folded into a U to form a fold 18*a*, cooperates with the fixing strip 16. The two folds 16*a* and 18*a* are fitted one into the other so that the weld support 18, which is in fact a strip of invar sheet, is held on the fixing strip 16 and consequently is made integral with the tanks 3 of the secondary insulating barrier, the method of fixing used nevertheless allowing the weld support 18 to slide with respect to the tank 3 in the longitudinal direction of these tanks, i.e. parallel to the internal bulkheads of the tanks. In order to ensure good resistance for the coupling 16/18, it is ensured that the width of the groove 15 is only slightly greater than the overall thickness of the two folds 16*a*, 18*a*, preventing opening of the folds and increasing the tensile force that can be supported by the weld support 18.

The secondary sealing barrier formed by strakes of invar sheet 19 0.5 mm thick with bent over edges 19*a* is mounted. These invar strakes 19 form strips which are substantially 50 cm wide between two bent over edges and are welded via their bent over edges to either side of the weld supports 18. The bent over edges 19*a* and the weld support 18 project beyond the surface formed by the strakes 19. As the welds of the bent over edges 19*a* are sealed, this produces a secondary sealing barrier fitted over the secondary insulating barrier.

In view of the presence of the fixing strips 16 and the weld supports 18, it is necessary to provide grooves 20 transversely in the insulating strips 11, these grooves 20 being disposed every 50 cm on those thick longitudinal edges situated in the immediate vicinity of the secondary sealing barrier and allowing for the passage of the sliding joint 16/18.

The secondary barrier being formed in this manner, plates designated in general by the reference numeral 21 are mounted between the weld supports 18, the said plates 21 forming the elements of the primary insulating barrier. Each plate 21 consists of a rectangular parallelepiped of polyurethane foam having a density of 80 kg/m$^3$. These plates have a width of 40 cm and a length of 3 m. They are placed on a plywood base 22 and are surmounted by a plywood covering panel 23. The parallelepiped of foam is bordered on its thick faces by peripheral plywood strips 24 and the base 22 projects with respect to the strips 24 over the entire length of the plates 21 so as to form a tongue which, when the plate 21 is mounted between two weld supports 18, comes into the vicinity of the bent over edges 19*a* of the secondary sealing barrier. The covering panel 23 stops slightly set back with respect to the peripheral strips 24 so as to allow for the mounting of a cover strip 25 which is a plywood plate forming the connection between the covering panels 23 of two adjacent plates 21. The cover strip 25 bears against the two peripheral strips 24 of two adjacent plates 21 and is fixed thereto by means of hooks 26. The connection of the peripheral strips 24 to the base 22 is also obtained by virtue of hooks 27. The connection of the parallelepipedal core of polyurethane foam to the covering panel 23 and the base 22 is obtained by gluing.

Figure 5:
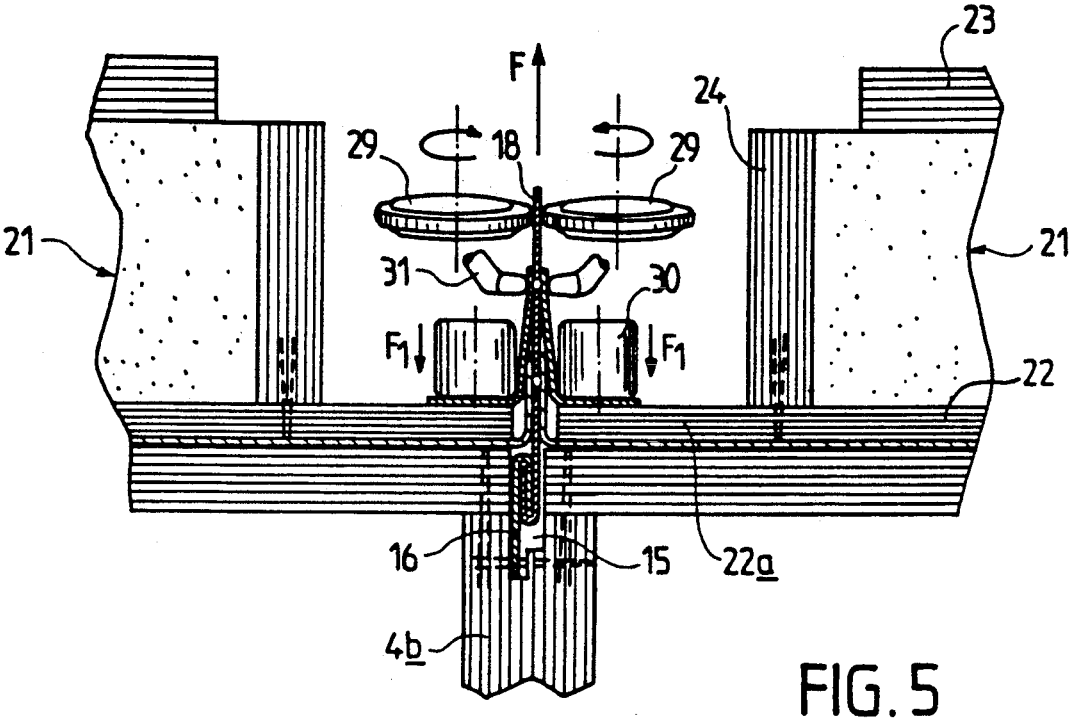
FIG. 5 is a diagrammatic representation of the mounting of the right-angled strips by spot welding to the weld support in order to fix the plates of the primary insulating barrier to the secondary sealing barrier.
Figure 6:
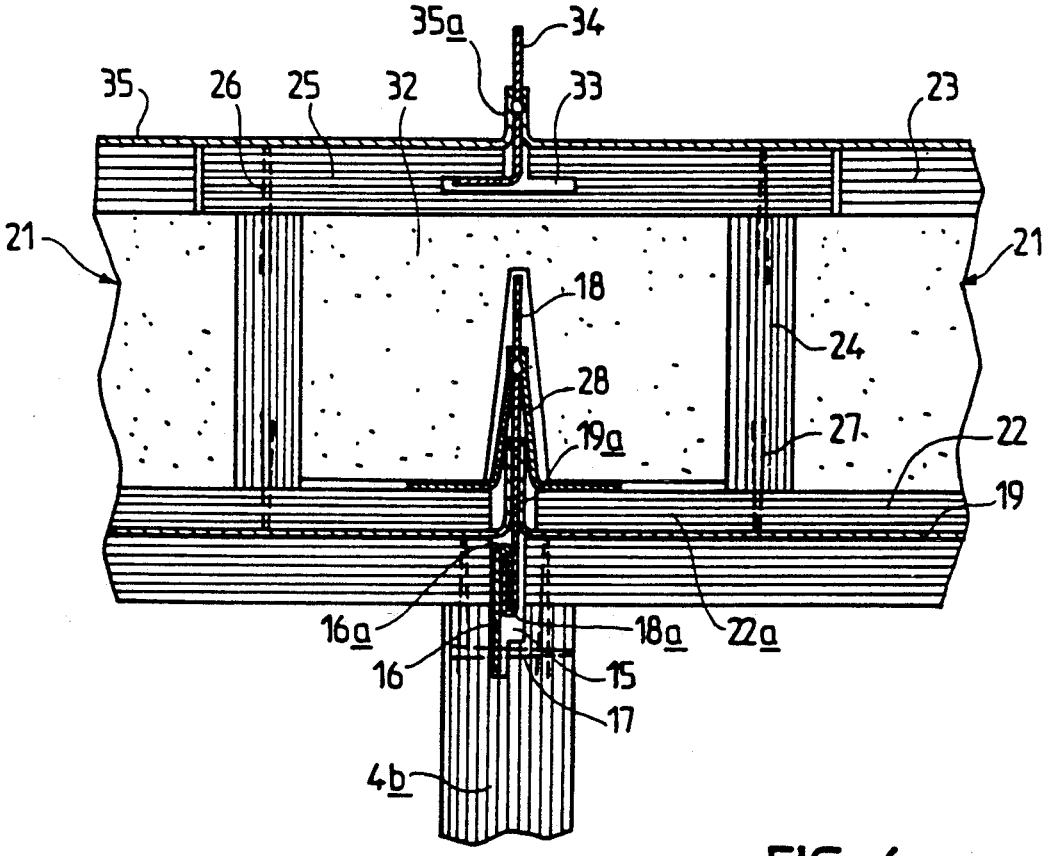
FIG. 6 is a section perpendicular to the plane of the sealing barriers of the vessel of the structure of the plates of the primary insulating barrier and the fixing devices of the two sealing barriers at right angles with a weld support.

When the plates 21 have been placed between the weld supports 18, they are made integral with the secondary barrier as indicated in FIG. 5. To this end, two angle brackets 28 made of invar sheet are pressed against either side of the weld support 18 by an automatic machine of known type, one of the flanges being applied to a tongue 22*a* and the other flange coming into contact with the weld support 18. The mounting machine has inclined rollers 29 which grip round the weld support 18 and exert a force thereon in the direction of the arrow F (see FIG. 5) while the rollers 30 of the machine exert a force on the bracket 28 in the direction of the arrows F1, intended to apply the bracket 28 to the tongue 22*a* on which it rests. Any play between the plate 21 and the second sealing barrier formed by the strakes of invar sheet 19 is eliminated in this manner. The mounting machine then effects spot welding by virtue of the electrodes 31, so that the relative positions of the bracket 28 and the weld support 18 are fixed. This operation is of course effected simultaneously on either side of the weld support 18. The distance between the two peripheral strips 24 of two adjacent plates 21 is approximately 80 mm, this being sufficient for the passage of the spot welding machine. Once this welding has been effected, a strip of polyurethane foam 32 having substantially the same thickness as that of the parallelepipedal slab stock forming the core of the plate 21 is mounted between the two adjacent peripheral strips 24 and above the weld support 18 associated with its brackets 28, and this strip 32 which fills the joint zone is covered by the cover strip 25 which is fixed by means of hooks 26. The surface of the cover strip 25 directed towards the interior of the vessel is situated at the outer surface of the covering panels 23. The thickness of the primary insulating barrier formed in this manner is 70 mm.

A continuous groove 33 having a T-shaped profile is formed along the median longitudinal line of the cover strips 25. A welding flange 34 folded at a right angle to form an L-shaped profile is mounted in this groove, the small side of which is engaged in one of the transverse branches of the T-shaped groove while the large side traverses the web of the T of the said groove and projects beyond the cover strip. Invar sheet strakes 35 with bent over edges 35*a* are mounted between the welding flanges 34. The width of the strakes 35 is approximately 50 cm, so that the bent over edges 35*a* are situated on either side of a welding flange 34. It is thus possible to form a continuous sealed weld in the known manner between the edges 35*a* and the welding flange 34 by means of an automatic machine. The primary sealing barrier is mounted and held in this manner.

The secondary insulating barrier is preferably mounted under low pressure, e.g. under an absolute pressure of 2 mbar. In view of the great thickness of 430 mm, the secondary insulating barrier thus has very high insulating properties. In order to establish the low pressure of 2 mbar, air is pumped into the secondary insulating layer. The tanks 3 may have orifices in their transverse edges to facilitate the intake of air into the tanks. The grooves 13 of the strips 11 allow for circulation of the air drawn in, in spite of the presence of the tapes 14 which are not mounted in a sealed manner. The tapes 14 are adapted to prevent the circulation of residual gas by natural convention between the grooves 13 and the space between the tanks 3 and the supporting structure 1, as circulation of this kind would lead to great heat loss.

Figure 7:
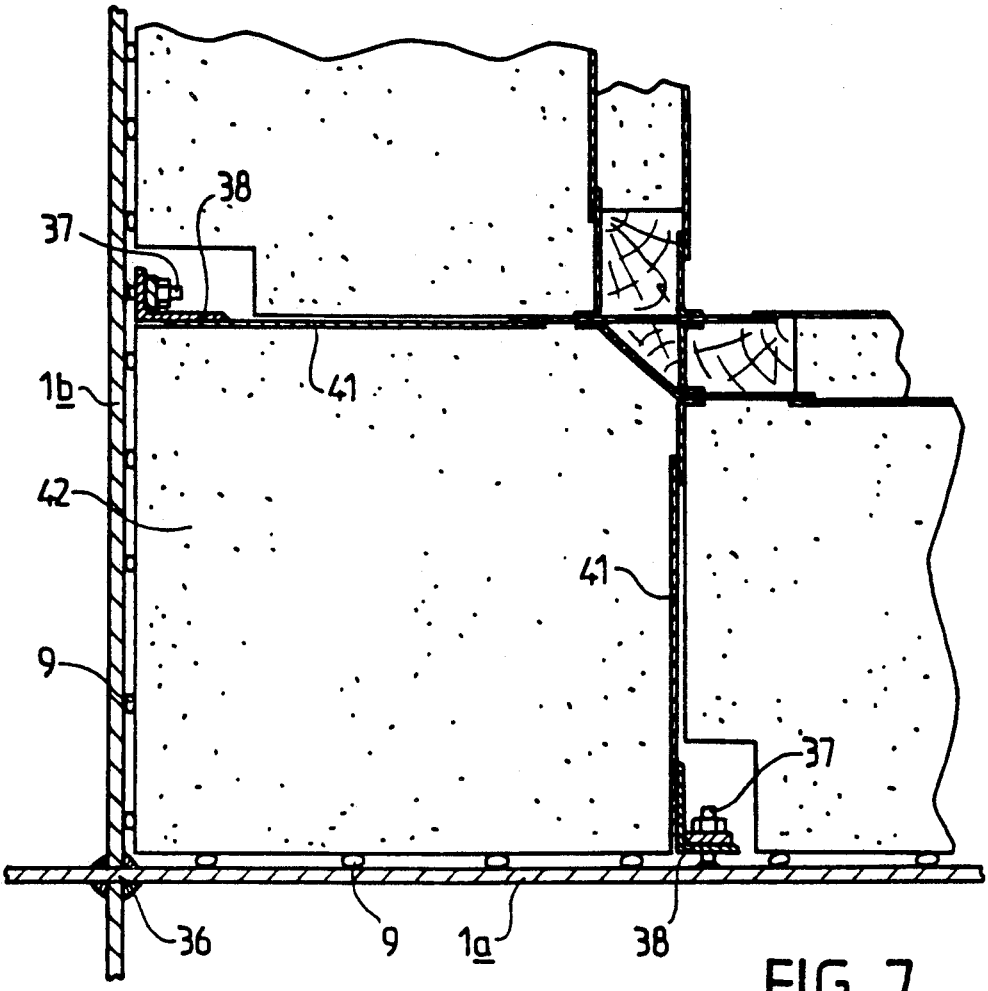
FIG. 7 shows an embodiment of a vessel corner viewed in section in a plane perpendicular to the ridge of the dihedron formed by the said corner.
Figure 7A:
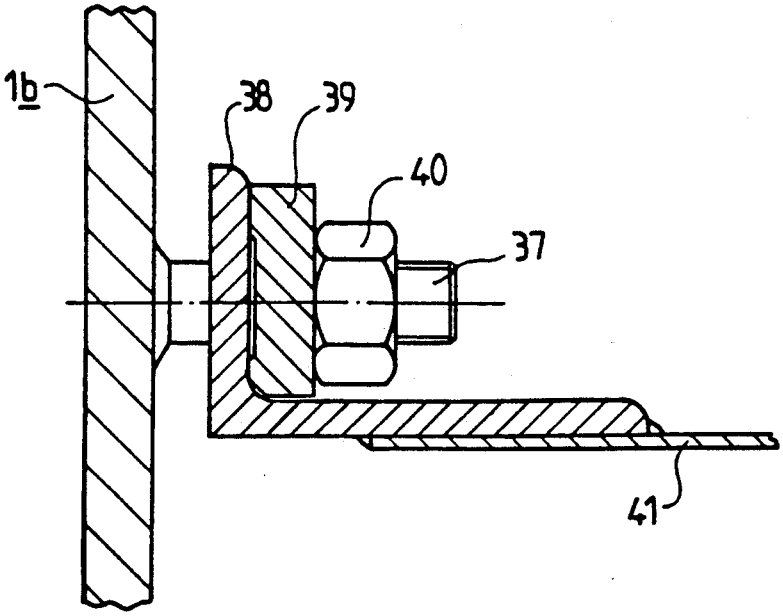
FIG. 7*a* is a detail of the production of a unidirectional connection used for the vessel corner of FIG. 7.

FIG. 7 shows the structure adopted in a vessel corner, i.e. in the zone in which a transverse bulkhead 1*b* of the ship is connected to the internal wall 1*a* of the double hull of the ship. The intersection 36 of the bulkheads 1*a* and 1*b* forms a closed polygon along which the structure which will now be described forms a ring. FIGS. 7 is a cross section of this ring zone.

The reference numeral 36 designates the edge of the dihedron formed by the corner of the vessel. A line of stud bolts 37 is provided approximately 530 mm from the edge 36, parallel to the edge 36 on each of the supporting bulkheads 1*a* and 1*b*. An angle bracket 38 is mounted on these bolts, one flange of which is positioned on the bolts 37 and is held there by means of a bar 39 which has the same length as the bracket 38 and increases the resistance of the latter or by means of the nuts 40 associated with the bolts 37. In the vicinity of the supporting bulkheads supporting them, the bolts 37 have a smooth bearing surface on which the bracket 38 can freely slide. It will therefore be seen that this mounting establishes a unidirectional connection which allows the bracket 38 to move closer to the supporting bulkhead, but which by means of the nut 40 establishes a limitation of the position of the bracket in the direction of the interior of the vessel.

The flange of the bracket 38 which does not cooperate with the bolts 37 is connected by welding to a connecting band 41 which consists of an invar sheet 2 mm thick situated substantially in the plane of the primary sealing barrier associated with that supporting bulkhead which does not support the angle bracket 38 of the band 41 in question. Before the connecting bands 41 are mounted, a secondary tank 42 of substantially square section is disposed in the edge dihedron 36 and bears against the bulkheads 1*a* and 1*b* by means of resin beads 9. The tank 42, like the tanks 3, is filled with a particular thermal insulant. The connecting bands 41 and the angle brackets 38 are then mounted on the two faces of the tank opposite the bulkheads 1*a* and 1*b*. The corner of the tank 42 opposite the edge 36 is broken to form a bevel.

Figure 8:
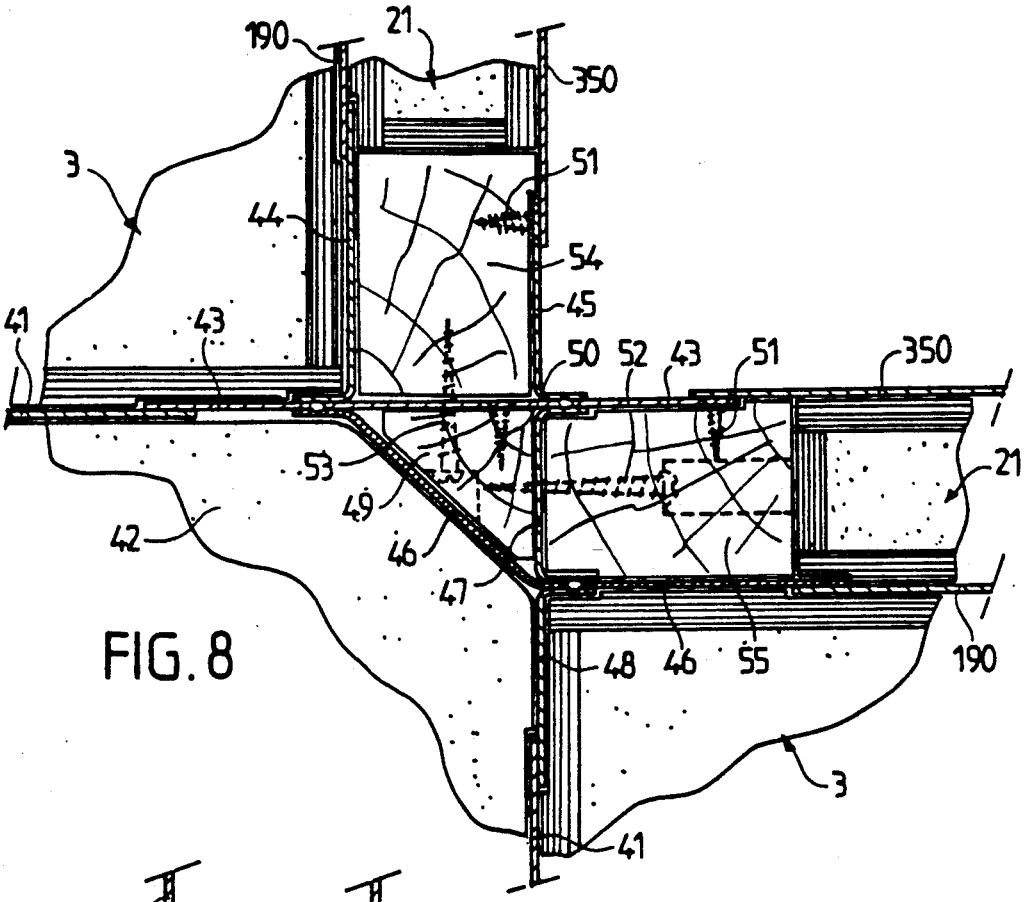
FIG. 8 is a detail of the connecting zone of the primary and secondary sealing barriers for the vessel corner of FIG. 7.

A prefabricated composite beam shown in detail in FIG. 8 is mounted on the corner prepared in this manner. This beam is in the shape of a dihedron, the two planes of the dihedron being perpendicular and being connected by a bevelled zone at an angle of 45°. The beam is formed in the following manner. An invar sheet 43 2 mm thick receives two invar sheets 44 and 45 1.5 mm thick perpendicular to the sheet 43 and welded thereto via their bent over edges. The sheets 44 and 45 are parallel and spaced at 70 mm. On its other face, the sheet 43 supports an invar sheet 46 1.5 mm thick disposed at an angle of 45° with respect to the sheet 43 and folded at right angles with the sheet 45 in order to become parallel again with the sheet 43. The sheet 46 is welded to the sheet 43 at the same level as the sheet 44 and a U-shaped bracket 47 is welded via its two flanges, on the one hand, to the sheet 43 at right angles with the weld of the sheet 45, but on the opposite side with respect to this sheet, and, on the other hand, to the sheet 46, the web of this bracket 47 being situated in the plane of the sheet 45. On the side of the sheet 46 at which the bracket 47 is not situated, and in the plane of the sheet 45, an invar sheet 48 1.5 mm thick is welded to the sheet 46 with bent over edges. A plywood beam 49 of substantially triangular section is mounted in the primsatic space of triangular section defined by the sheets 43 and 46 and by the web of the bracket 47, and is held in its sheet housing by means of screws 50 traversing the sheet 43 in the space between the sheets 44 and 45. Plywood beams 54, 55 of substantially rectangular section are mounted in each of the spaces between, on the one hand, the sheets 43, 44 and 45 and, on the other hand, between the sheets 43 and 46 and the web of the bracket 47, these beams being held with respect to the sheets surrounding them by means of screws 51 disposed on the side of the centre of the vessel on the sheets 45 and 43 respectively. In order to complete the connection of the beams to their sheet casings, the screws 52, 53 are mounted and respectively connect the beam 55 to the beam 49 passing through the web of the bracket 47 on the one hand and the beam 49 to the beam 54 passing through the sheet 43 on the other hand.

The composite beam which has just been described is brought against the tank 42, the sheet 46 coming to bear against the bevel of the said tank. In this position, the sheets 43 and 48 come to rest on the connecting bands 41, ensuring a continuous sealed weld on the edge of the cover. In this position, the sheet 43 is situated substantially in the plane of the primary sealing barrier and the sheet 46 in the plane of the secondary sealing barrier parallel to the supporting bulkhead 1*a*. Similarly, the sheet 44 is situated substantially in the plane of the secondary sealing barrier and the sheet 45 in the plane of the primary sealing barrier parallel to the supporting bulkhead 1*b*. These sheets of the composite beam therefore simply have to be connected by sealed welding to the invar strakes forming the primary and secondary sealing barriers. The reference numeral 350 designates the end edges of the sheets forming the primary sealing barrier. It will be seen that these sheets cover the zones in which the screws 51 are situated so that the seal is not destroyed by the presence of the said screws 51. The zone in which the screws 52 and 53 are situated does not need to be sealed as it corresponds to the thickness of the primary insulating barrier.

It will be noted that this structure allows for the perfect transfer of the forces exerted on the primary and secondary barriers to the supporting bulkheads. By using bolts 37 with a diameter of 15 mm at a rate of 10 bolts per linear meter, it is simple to withstand the static load resulting from the cooling of the vessels and the dynamic stresses during sailing. The static load is applied only to the band 41 parallel to the transverse bulkhead, while the band 41 parallel to the double hull supports both the static load and the dynamic stresses. The use of a unidirectional connection at the brackets 38 allows for recoil under load of the said brackets when the vessels are loaded. The corner structure which has just been described in fact makes it possible to withstand in a simple manner considerable tensile forces exerted on the sealing barriers but does not make it possible to withstand compressive stresses as there would be a risk of deformation of the sheets of the composite beams, leading to destruction of the welds and a loss of sealing.

Figure 9:
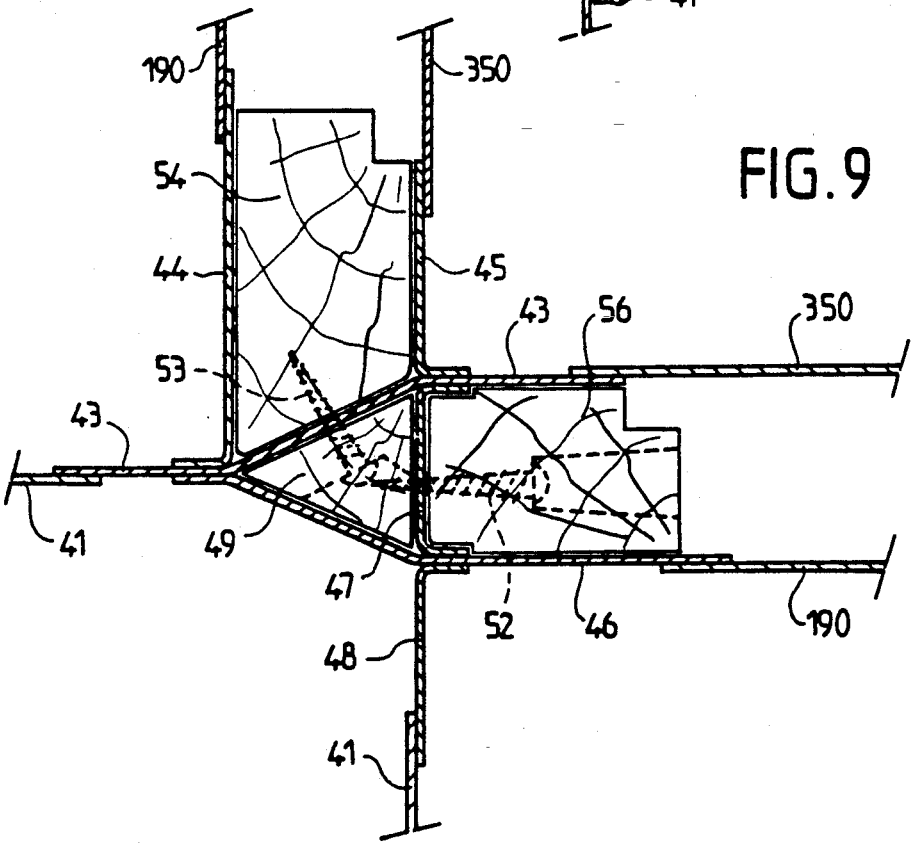
FIG. 9 shows a variant embodiment of the connecting zone of FIG. 8.

FIG. 9 shows a variant embodiment of the corner ring defined in FIGS. 7 and 8, FIG. 9 only showing the corner zone of the composite beam without indicating the primary and secondary tanks adapted substantially thereto as in the first embodiment. In this variant, the composite beam allows for improved distribution of the static load and dynamic stresses applied over the band 41 parallel to the double hull by virtue of a symmetrical connection (43, 46) established by the triangular zone of the beam between the said band 41 and the primary 350 and secondary 190 sealing barriers parallel to the double hull. As the stresses in the longitudinal direction are the greatest, the disymmetry parallel to the transverse bulkhead does not pose a problem. The various elements of the beam have been given the same reference numerals as in the first embodiment. The sheets forming the beam are invar sheets 1.5 mm thick, except for the sheet 43 which is 2 mm thick. The three compartments defined by these sheets are occupied by wooden beams 49, 54, 56. The assembly formed in this manner is connected to the primary and secondary sealing barriers as indicated hereinbefore for the variant of FIGS. 7 and 8.

It will be noted that the vessel structure described hereinabove eliminates all traversing of the secondary sealing barrier by members adapted to hold the primary insulating and sealing barriers on the supporting bulkhead. This avoids a thermal bridge. Moreover, by virtue of the fact that the tanks 3 are fixed by means of lugs with folded over edges, greater dynamic deformation of the hull can be tolerated than previously. Finally, by virtue of the fact that the primary barrier is coupled just at right angles with the retaining members holding the secondary barrier on the supporting bulkhead, it is possible to reduce the deformation of the tanks during sailing.

The embodiment described hereinabove is of course in no way limiting and can be modified as desired without thereby going beyond the scope of the invention.

I claim:

1. Sealed thermally insulating vessel forming part of the supporting structure of a ship, the said vessel having two successive sealing barriers, a primary sealing barrier in contact with the product contained in the vessel and the other secondary sealing barrier disposed between the primary barrier and the supporting structure of the ship, these two sealing barriers alternating with two thermally insulating barriers, the primary insulating barrier bearing elastically against the secondary sealing barrier by virtue of coupling means disposed in a substantially continuous linear manner and mechanically connected to the secondary insulating barrier, the primary insulating barrier consisting of substantially parallelepipedal rigid plates (21) between which the said coupling means pass, the secondary insulating barrier consisting of an assembly of substantially parallelepipedal insulating tanks (3) provided with internal bulkheads fixed to the supporting structure of the ship by means of retaining members (2, 7) integral with the said supporting structure which cooperate with fixing devices (5) disposed along the edge of the tanks of the secondary insulating barrier, the said tanks (3) being separated from one another by substantially rectilinear joint zones in which the aforesaid retaining members (2, 7) are disposed, each tank (3) having groove (15) adapted to receive a coupling means, and having, at right angles with each groove (15) adapted to receive a coupling means, a thick internal bulkhead (4*b*) fixed to the faces defining the tank (3), characterized in that, outside the vessel corners, the retaining members (2) used to hold the secondary insulating barrier on the supporting structure of the ship are aligned at right angles with the grooves (15) in which the coupling means are inserted.

2. Vessel according to claim 1, in which each retaining member has, on the one hand, a stud bolt (2) welded via its base to the supporting structure (1) of the ship and, on the other hand, a nut (7) which bears against a fixing device integral with a tank (3) of the secondary insulating barrier, characterised in that the said fixing device is the elastically deformable folded over edge (5*a*) of a lug (5) fixed to the narrow side of each tank (3) at right angles with the end cross section of each thick bulkhead (4*b*) of the tank (3).

3. Vessel according to claim 2, characterised in that the nut (7) bears against a lug (5) by means of a plate (6) which bears simultaneously against two lugs (5) belonging to two adjacent tanks (3).

4. Vessel according claims 1, characterised in that the secondary sealing barrier consists of metal strakes (19) with edges (19*a*) bent over towards the interior of the vessel, the said strakes being made of sheet metal with a low coefficient of expansion and being butt welded via their bent over edges (19*a*) to the two faces of a weld support (18) which is held mechanically on the elements of the secondary insulating barrier by a sliding joint.

5. Vessel according to claim 4, characterized in that each coupling means consists of a first and a second part, the weld support (18) forming a first part of said coupling means and wherein said weld support has its free end set back with respect to the plane of the primary sealing barrier, the rigid plates (21) of the primary insulating barrier having, with respect to each weld support (28) and over their entire length, a fixing tongue (22*a*), two right-angled strips (28) being welded to either side of the said weld support (18) and bearing elastically via their non-welded flange against the said tongues (22*a*) in order to form a second part of a coupling means.

6. Vessel according to claim 5, characterized in that the sliding joint which holds the weld support (18) on the tanks (3) of the secondary insulating barrier, contains on the one hand, a first U-shaped fold (18*a*) formed on a longitudinal edge of the weld support (18) and, on the other hand, a second U-shaped fold (16*a*) formed on a fixing strip (16), the two folds (16*a*/18*a*) fitting one into the other, each fixing strip (16) being mounted and held in one of the grooves (15) formed at right angles with each thick bulkhead (4*b*) of the tanks (3), the width of the said groove (15) only being slightly greater than that of the two folds (16*a*/18*a*) fitting one into the other.

7. Vessel according to claim 6, characterised in that a fixing strip (16) can be held in its groove (15) by retaining means (17) which traverse transversely at the groove (15) of the thick bulkhead (4*b*) where the said fixing strip (16) is disposed.

8. Vessel according to claim 5, characterized in that a cover strip (25) is disposed at right angles with each weld support (18) and the tongues (22*a*) of the plates (21) of the primary insulating barrier with which it cooperates, and wherein the face of said cover strip is directed towards the interior of the vessel being level with the faces of the plates (21) of the primary insulating barrier which supports the primary sealing barrier.

9. Vessel according to claim 1, characterised in that the tanks (3) of the secondary insulating barrier bear against the supporting structure (1) of the ship by means of beads (9) made of a curable resin, these beads restoring a defined geometrical surface by means of discontinuous elements, irrespective of the random spacings of the supporting structure in the static state with respect to its ideal calculated surface.

10. Vessel according to claim 9, characterised in that a film of plastic material (10) is interposed between the supporting structure (1) and the resin beads (9).

11. Vessel according to claim 9, characterised in that the joint zones between the tanks (3) of the secondary insulating barrier are filled with an insulating material.

12. Vessel according to claim 11, characterised in that the insulating material filling the joint zones is in the form of a strip (11), the thickness of which corresponds to that of the joint zone to be filled, the said strip (11) comprising laterally at least one longitudinal groove (13) closed in a non-sealed manner at its ends.

13. Vessel according to claim 1, characterised in that the secondary insulating barrier is under a low pressure of between 0.1 and 300 mbar.

14. Vessel according to claim 1, characterised in that the plates (21) forming the primary insulating barrier are formed by a layer of cellular material wedged between two rigid panels (22, 23).

15. Vessel according to claim 1, characterised in that the primary insulating barrier is swept by a neutral gas.

16. Vessel according to claim 1, characterised in that the primary sealing barrier is formed by metal strakes (35) with edges (35*a*) bent over towards the interior of the vessel, the said strakes (35) consisting of sheet metal having a low coefficient of expansion and being butt welded via their bent over edges (35*a*) to the two faces of a welding flange (34) which is held mechanically by a cover strip (25) of the primary insulating barrier.

17. Vessel according to claim 1 characterized in that, in a corner formed by the double hull (1*a*) and a transverse bulkhead (1*b*) of the ship, two perpendicular anchoring bands (41) connected by means of sheets (43, 48) folded at a right angle to the two secondary sealing barriers are coupled to the perpendicular supporting walls by means of a unidirectional connection, the said sheets (43, 48) being connected to one another by a connecting band (46) perpendicular to the plane bisecting the corner in question, at least one of the anchoring bands (41) extending substantially in its plane beyond the sheet (44) folded at a right angle connected thereto in order to join the primary sealing barrier associated with one (1*a*) of the supporting walls of the corner in question, the primary sealing barrier associated with the other supporting wall (1*b*) being connected by the sealed welding of a sheet (45) folded at a right angle to the sheet (43) adjacent thereto and possibly to the anchoring band (41) situated in its plane.

18. Vessel according to claim 17, characterised in that the unidirectional connection of an anchoring band (41) has stud bolts (37) fixed to the supporting structure of the ship and an anchoring bracket (38) having a right-angled profile, one flange of which is held on each bolt (37) by the nut (40) associated with the latter and the other flange of which is welded to the anchoring band (41), the said anchoring bracket (38) being free to move towards its associated supporting wall.

* * * * *